US006750413B1

(12) United States Patent
Dove et al.

(10) Patent No.: US 6,750,413 B1
(45) Date of Patent: Jun. 15, 2004

(54) LIQUID METAL MICRO SWITCHES USING PATTERNED THICK FILM DIELECTRIC AS CHANNELS AND A THIN CERAMIC OR GLASS COVER PLATE

(75) Inventors: Lewis R Dove, Monument, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/423,316

(22) Filed: Apr. 25, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |
| 4,103,135 A | | 7/1978 | Gomez et al. | |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | | 2/1984 | Becker | |
| 4,475,033 A | | 10/1984 | Willemsen et al. | |
| 4,505,539 A | | 3/1985 | Auracher et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 62-276838 | 12/1987 |
| JP | 63-294317 | 12/1988 |
| JP | 8-125487 | 5/1996 |
| JP | 9-161640 | 6/1997 |
| SH | 47-21645 | 10/1972 |
| WO | WO99-46624 | 9/1999 |

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Ceramic Multilayer Package Fabrication", Electronic Materials Handbook, Nov. 1989, pp. 460–469, vol. 1 Packaging, Section 4: Packages.

Kim, Joonwon, et al., "A Micromechanical Switch With Electrostatically Driven Liquid–Metal Droplet", Sensors And Actuators, A; Physical v 9798, Apr. 1, 2002, 4 pages.

Simon, Jonathan, et al., "A Liquid–Filled Microrelay With A Moving Mercury Microdrop", Journal of Microelectromechanical Systems, Sep. 1997, pp 208–216, vol. 6, No. 3.

*Primary Examiner*—Michael A. Friedhofer
(74) *Attorney, Agent, or Firm*—Edward L. Miller

(57) ABSTRACT

Channels and cavities in a LIMMS device are formed from a layer of thick film dielectric material deposited on a substrate, which layer is then covered with a thin cover plate of ceramic or perhaps glass. The layer of dielectric material may be patterned using established thick film techniques, and good dimensional control can be achieved. The dielectric layer is itself its own hermetic seal against the substrate, and readily lends itself to the formation of the additional hermetic seal needed between itself and the cover plate. Suitable thick film dielectric materials that may be deposited as a paste and subsequently cured include the KQ 150 and KQ 115 thick film dielectrics from Heraeus and the 4141A/D thick film compositions from DuPont.

8 Claims, 6 Drawing Sheets

U.S. PATENT DOCUMENTS 4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

LIQUID METAL MICRO SWITCHES USING PATTERNED THICK FILM DIELECTRIC AS CHANNELS AND A THIN CERAMIC OR GLASS COVER PLATE

BACKGROUND OF THE INVENTION

Recent developments have occurred in the field of very small switches having moving liquid metal-to-metal contacts and that are operated by an electrical impulse. That is, they are actually small latching relays that individually are SPST or SPDT, but which can be combined to form other switching topologies, such as DPDT. (Henceforth we shall, as is becoming customary, refer to such a switch as a Liquid Metal Micro Switch, or LIMMS.) With reference to FIGS. 1–4, we shall briefly sketch the general idea behind one class of these devices. Having done that, we shall advance to the topic that is most of interest to us, which is an improved technique for forming the needed channels and cavities of such switches fabricated on a substrate.

Refer now to FIG. 1A, which is a top sectional view of certain elements to be arranged within a cover block 1 of suitable material, such as glass. The cover block 1 has within it a closed-ended channel 7 in which there are two small movable distended droplets (12, 13) of a conductive liquid metal, such as mercury. The channel 7 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 5 and 6, within which are respective heaters 3 and 4, each of which is surrounded by a respective captive atmosphere (10, 11) of a suitable gas, such as $N_2$. Cavity 5 is coupled to the channel 7 by a small passage 8, opening into the channel 7 at a location about one third or one fourth the length of the channel from its end. A similar passage 9 likewise connects cavity 6 to the opposite end of the channel. The idea is that a temperature rise from one of the heaters causes the gas surrounding that heater to expand, which splits and moves a portion of the long mercury droplet, forcing the detached portion to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of a millisecond, or less. The small size also lends itself for use amongst controlled impedance transmission line structures that are part of circuit assemblies that operate well into the microwave region.

To continue, then, refer now to FIG. 1B, which is a sectional side view of FIG. 1A, taken through the middle of the heaters 3 and 4. New elements in this view are the bottom substrate 2, which may be of a suitable ceramic material, such as that commonly used in the manufacturing of hybrid circuits having thin film, thick film or silicon die components. A layer 14 of sealing adhesive bonds the cover block 1 to the substrate 2, which also makes the cavities 5 and 6, passages 8 and 9, and the channel 7, each moderately gas tight (and also mercury proof, as well!). Layer 14 may be of a material called CYTOP (a registered trademark of Asahi Glass Co., and available from Bellex International Corp., of Wilmington, Del.). Also newly visible are vias 15–18 which, besides being gas tight, pass through the substrate 2 to afford electrical connections to the ends of the heaters 3 and 4. So, by applying a voltage between vias 15 and 16, heater 3 can be made to become very hot very quickly. That in turn, causes the region of gas 10 to expand through passage 8 and begin to force long mercury droplet 12 to separate, as is shown in FIG. 2. At this time, and also before heater 3 begins to heat, long mercury droplet 12 physically bridges and electrically connects contact vias 19 and 20, after the fashion shown in FIG. 1C. Contact via 21 is at this time in physical and electrical contact with the small mercury droplet 13, but because of the gap between droplets 12 and 13, is not electrically connected to via 20.

Refer now to FIG. 3A, and observe that the separation into two parts of what used to be long mercury droplet 12 has been accomplished by the heated gas 10, and that the right-hand portion (and major part of) the separated mercury has joined what used to be smaller droplet 13. Now droplet 13 is the larger droplet, and droplet 12 is the smaller. Referring to FIG. 3B, note that it is now contact vias 20 and 21 that are physically bridged by the mercury, and thus electrically connected to each other, while contact via 19 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small (less than a tenth of an inch on a side and perhaps only twenty or thirty thousandths of an inch high). They have decent isolation, are reasonably fast with minimal contact bounce. There are versions where a piezo-electrical element accomplishes the volume change, rather than a heated and expanding gas. There also exist certain refinements that are sometimes thought useful, such as bulges or constrictions in the channel or the passages. Those interested in such refinements are referred to the Patent literature, as there is ongoing work in those areas. See, for example, U.S. Pat. No, 6,323,447 B1.

To sum up our brief survey of the starting point in LIMMS technology that is presently of interest to us, refer now to FIG. 4. There is shown an exploded view 32 of a slightly different arrangement of the parts, although the operation is just as described in connection with FIGS. 1–3. In particular, note that in this arrangement the heaters (3, 4) and their cavities (5, 6) are each on opposite sides of the channel 7. Another new element to note in FIG. 4 is the presence of contact electrodes 22, 23 and 24. These are (preferably thin film) depositions of metal that are electrically connected to the vias (19, 20 and 21, respectively). They not only serve to ensure good ohmic contact with the droplets of liquid metal, but they are also regions for the liquid metal to wet against, which provides some hysteresis in the pressures required to move the droplets. This helps ensure that the contraction caused by the cooling (and contraction) of the heated (and expanded) operating medium does not suck the droplet back toward where it just came from. The droplets of liquid metal are not shown in the figure.

If contact electrodes 22–24 are to be produced by a thin film process, then they will most likely need to be fabricated after any thick film layers of dielectric material are deposited on the substrate (as will occur in connection with many of the remaining figures). This order of operations is necessitated if the thick film materials to be deposited need high firing temperatures to become cured; those temperatures can easily be higher than what can be withstood by a layer of thin film metal. Also, if the layer of thin film metal is to depart from the surface of the substrate and climb the sides of a channel, then it might be helpful if the transition were not too abrupt.

LIMMS devices can be combined into structures that have several switches under one cover block. Thus, the "floor plan" of a LIMMS device can range from relatively simple to fairly complex. Ease of manufacture and control of tolerances are important considerations for any fabrication technique that is to be practiced for volume production. The presently known techniques for creating individual cover blocks of etched glass or ceramic material require that they be first formed and then positioned, adhered and then hermetically sealed. It is not that the prior art does not work, but it becomes awkward, inefficient and expensive when production volume increases, especially when the LIMMS themselves, or the arrangement of LIMMS within an assembly, become complex. It would therefore be advantageous if there were an inexpensive, controllable and scalable way of forming the needed channels and cavities within LIMMS devices of increasing complexity. What to do?

SUMMARY OF THE INVENTION

An attractive solution to the problem of efficient fabrication of the channels and cavities in a LIMMS device is to form them from a layer of thick film dielectric material deposited on a substrate, and then cover the layer with a thin cover plate of ceramic or perhaps glass. The layer of dielectric material may be patterned using established thick film techniques. It is essentially as easy to do this for complicated multi-LIMMS arrangements, and for LIMMS of complicated internal structure, as it is for simple arrangements and structures, and good dimensional control can be achieved. The dielectric layer is itself its own hermetic seal against the substrate, and readily lends itself to the formation of the additional hermetic seal needed between itself and the cover plate.

This plan depends upon the use of a suitable dielectric material, which must be strong, adheres well to the substrate, is impervious to contaminants, is capable of being patterned, and if also desired, which can be metalized for soldering. It should also have well controlled and suitable properties as a dielectric. Given a choice, a lower dielectric constant (K) is preferable over a higher one. Suitable thick film dielectric materials that may be deposited as a paste and subsequently cured include the KQ 150 and KQ 115 thick film dielectrics from Heraeus and the 4141 A/D thick film compositions from DuPont.

DESCRIPTION OF A PREFERRED EMBODIMENT

Figure 5:
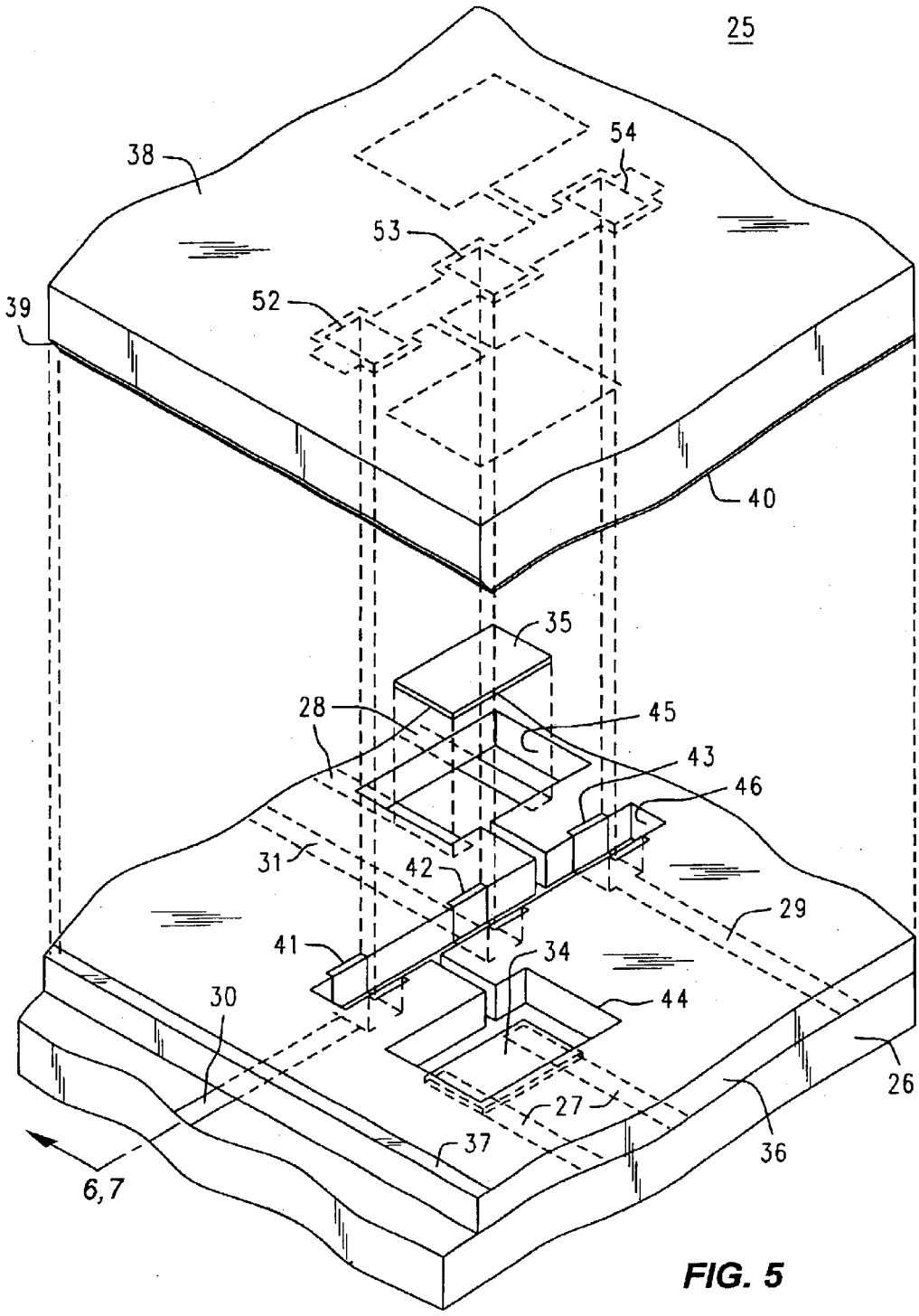
FIG. 5 is a simplified exploded view of a LIMMS device that is fabricated with a ceramic cover plate disposed atop a layer of patterned thick film dielectric.

Refer now to FIG. 5, wherein is shown a simplified representation 25 of a LIMMS device constructed in accordance with various principles of the invention. The figure shows a portion of a substrate 26, which may be of ceramic or glass, and which serves as a base upon which to fabricate the LIMMS device. Various metal conductors 27–31, which may be of gold, are deposited on the top surface of the substrate 26, or they may be what remains from a patterned removal of an entire metal sheet originally present on the surface of the substrate. The latter case cooperates nicely in instances where some of the conductors are to be co-planar transmission lines formed with the presence of a ground plane. Mercury amalgamates with gold, and if enough mercury is present, will dissolve it. It is therefore desirable to protect the gold with a covering of another metal, such as chromium or molybdenum. (Owing to the possibility of mercury smears during assembly, a complete over-covering of all the gold is more desirable than simply the exposed pads where the slug of mercury might be expected.) In the figure, conductors 27 and 28 are drive lines for heater resistors 34 and 35, respectively. Conductors 29, 30 and 31 are switched signal lines that might also be parts of a controlled impedance transmission line structure (no adjoining ground plane is shown—the figure is already pretty busy). An alternative that is not shown is that some or all of the conductors 27–31 are on the other (bottom) surface of the substrate 26, and that they have vias to connect them with necessary components on the top side of the substrate.

Now note patterned layer 36. It is applied over the various conductors 27–31, and may be of KQ 150 or KQ 115 thick film dielectric material from Heraeus, or the 4141A/D thick film compositions from DuPont. These are materials that are applied as pastes and then cured under heat at prescribed temperatures for prescribed lengths of time. Depending upon the particular material, they may be applied as an undifferentiated sheet, cured and then patterned (say, by laser or chemical etching) or they may be patterned upon their initial application (via a screening process). In any event, the patterning produces the heater cavities 44 and 45, the liquid metal channel 46 and their interconnecting passages.

Figure 1A:
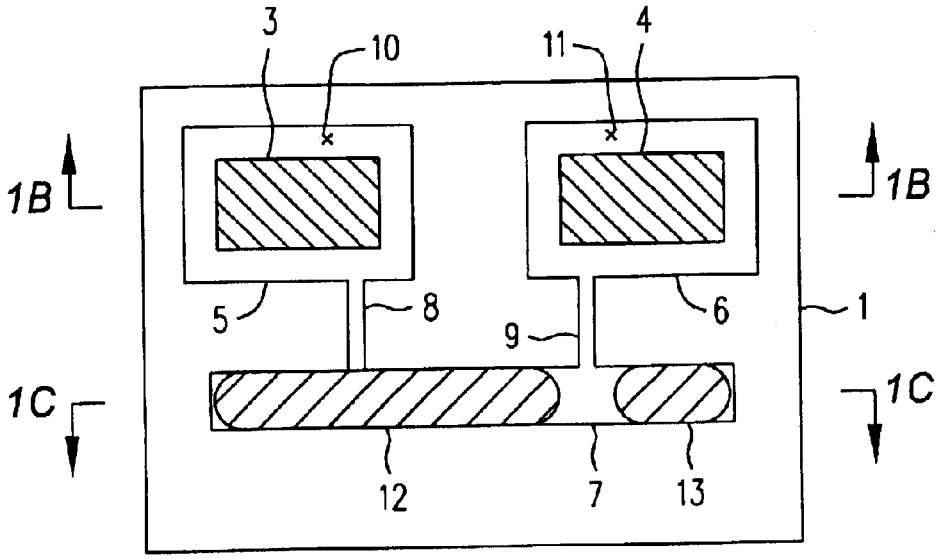
FIG. 1A PRIOR ART
FIGS. 1A–C are various sectional views of a prior art SPDT Liquid Metal Micro Switch LIMMS), and wherein for convenience, while the heaters are shown as located on opposite ends of the channel, they are also shown as being on the same side thereof.
Figure 1B:
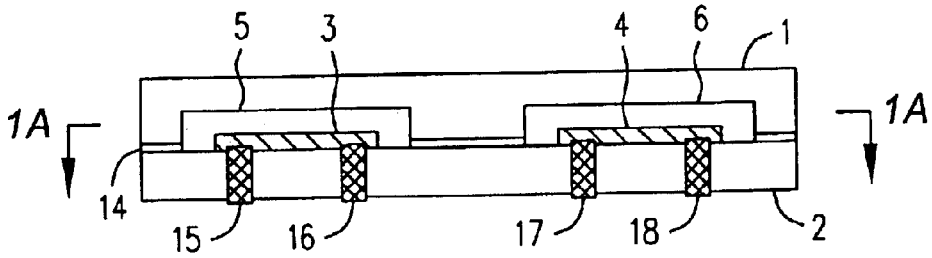
FIG. 1B PRIOR ART
Figure 1C:
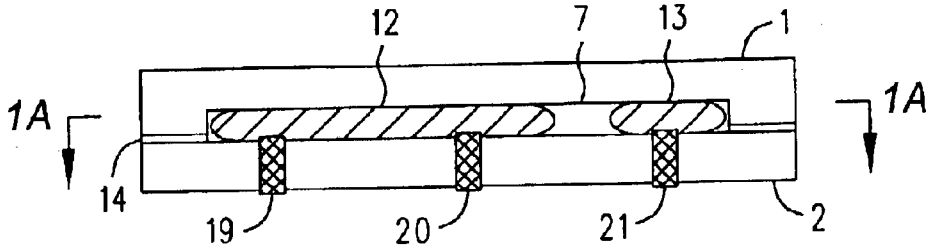
FIG. 1C PRIOR ART
Figure 2:
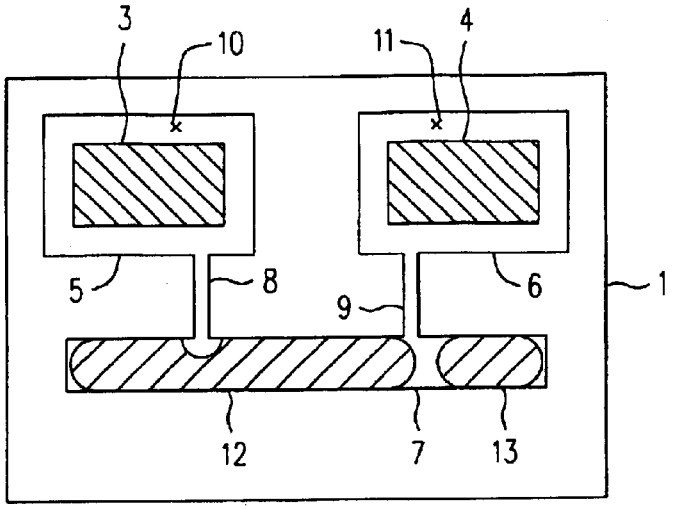
FIG. 2 PRIOR ART
FIG. 2 is a sectional view similar to that of FIG. 1A, at the start of an operational cycle.
Figure 3A:
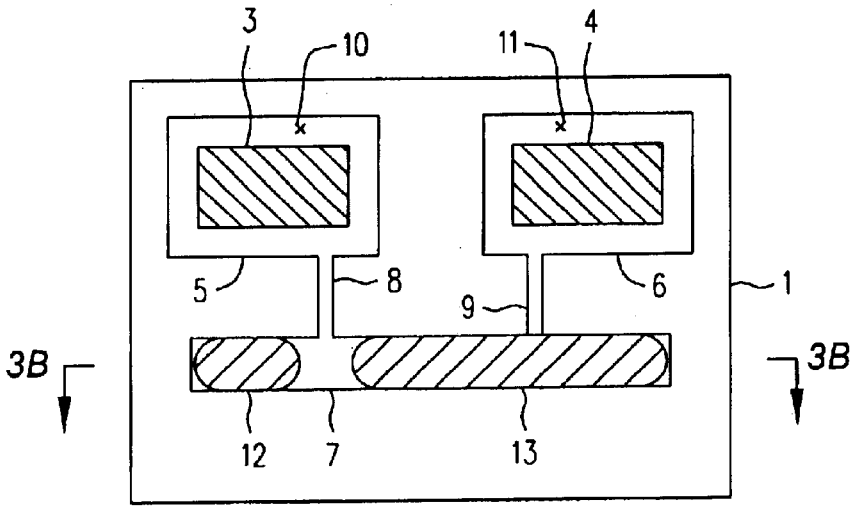
FIG. 3A PRIOR ART
FIGS. 3A–B are sectional views of the LIMMS of FIGS. 1A–C at the conclusion of the operation begun in FIG. 2.
Figure 3B:
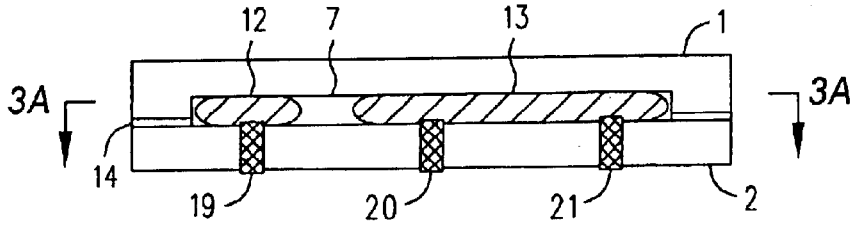
FIG. 3B PRIOR ART
Figure 6:
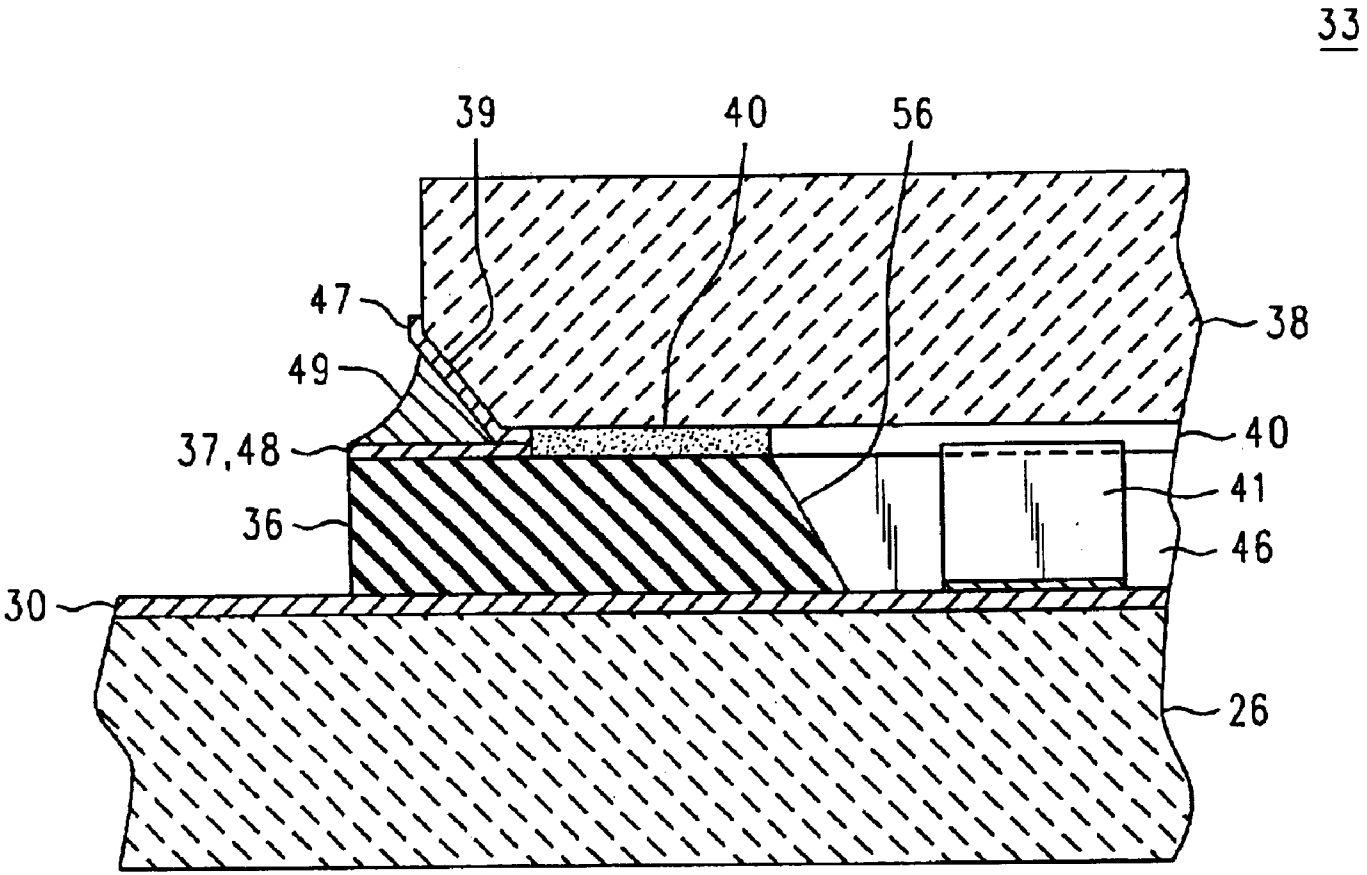
FIG. 6 is a simplified cross sectional view of the embodiment of FIG. 5 in the vicinity of where the ceramic cover plate is hermetically sealed with solder.
Figure 7:
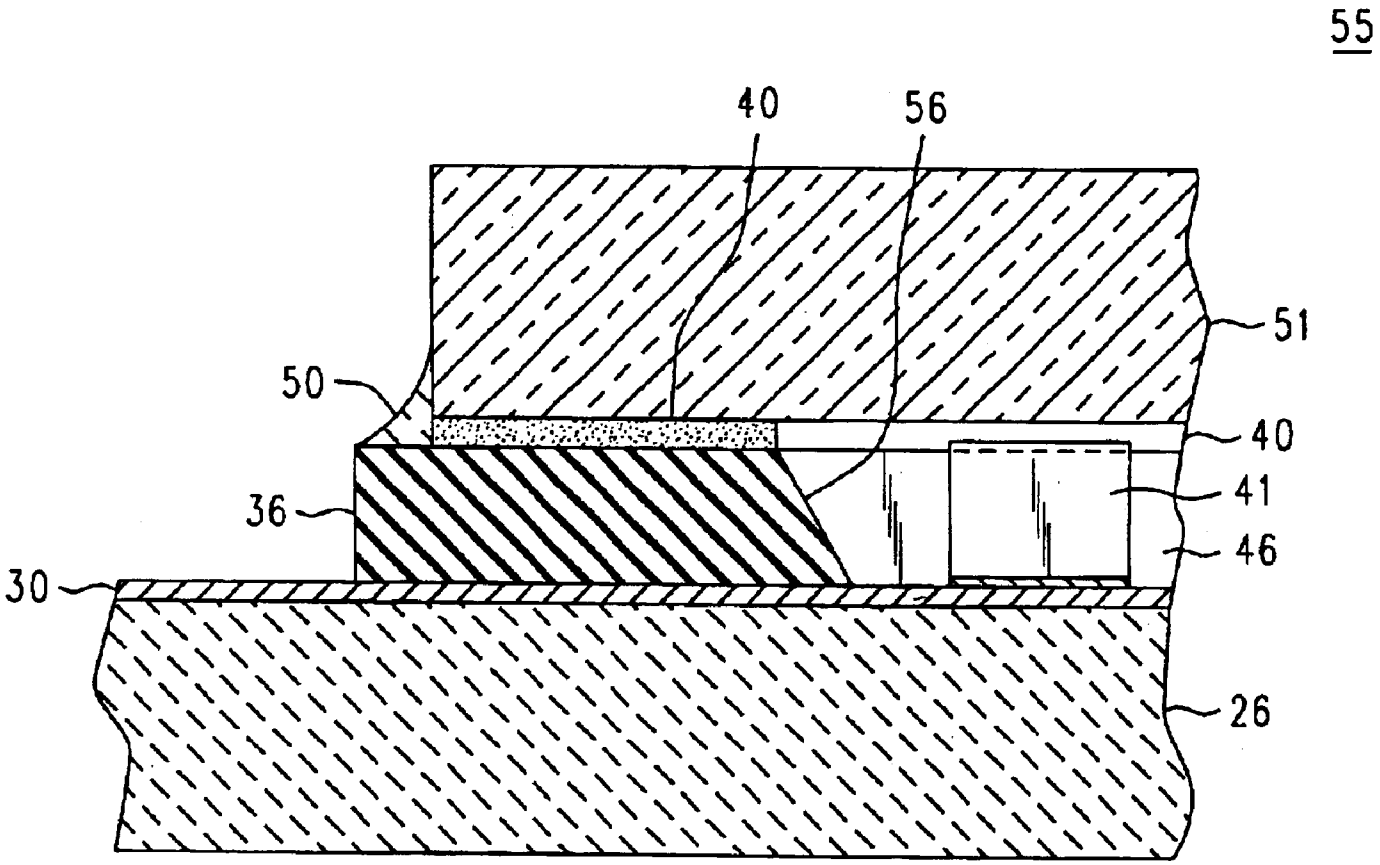
FIG. 7 is a simplified cross sectional view of an embodiment, similar to that of FIGS. 5 and 6, in the vicinity of where a glass cover plate is hermetically sealed with a glass frit.

The conventional thick film processes used to print patterned layers of the dielectric material allows considerable control over the finished thickness of a cured layer of dielectric material (say, in the range of five to ten thousandths of an inch), and achieving sufficient uniformity of thickness is not a major difficulty. However, there are limits to how thin and how thick an uncured printed layer can be, and it may be necessary to apply (print) multiple layers to achieve a particular overall depth for layer 36. For the KQ material that is to be printed on using a fine mesh (screen) of stainless steel, a printed uncured layer is on the order of one to two thousandths of an inch in thickness. The KQ material shrinks in thickness by an amount of about thirty percent during the curing process. It is possible to print several uncured layers, one on top of the other, and then fire the whole works, or, the application sequence could be print-fire-print-fire . . . , or even print-print . . . print-fire-print-print . . . During the firing for curing the steep side walls and relatively sharp edges possible for the uncured printed layers become sloped and rounded, respectively. The resulting trapezoidal cross-sectional shape of the liquid metal channel 46 may be a significant influence in determining a desired thickness for layer 36. In this connection, the view shown in FIG. 5 is a considerable simplification, in that, for simplicity of the drawing, the heater cavities 44 and 45, liquid metal channel 46, and their interconnecting passages (not numbered in FIG. 5, but are shown as 8 and 9 in FIGS. 1 and 2) are all depicted as having steep side walls and sharp edges. It makes the basic subject matter of the drawing much easier to appreciate. When using printed KQ, however, the actual situation is much close to what is shown in FIGS. 6 and 7. Note the sloping side walls 56 of patterned layer 36 of dielectric material. Steep sidewalls and sharp edges are not necessarily bad, and can be obtained with other fabrication techniques, although that may also have an effect on the method used to create metalized regions 41–43.

In preparation for later steps, the top surface of the layer 36 of cured dielectric material may be lapped to endure smoothness or to trim its thickness. Such lapping may or may not be needed, and might occur either before or after the patterning of a solid layer of cured dielectric material.

Figure 4:
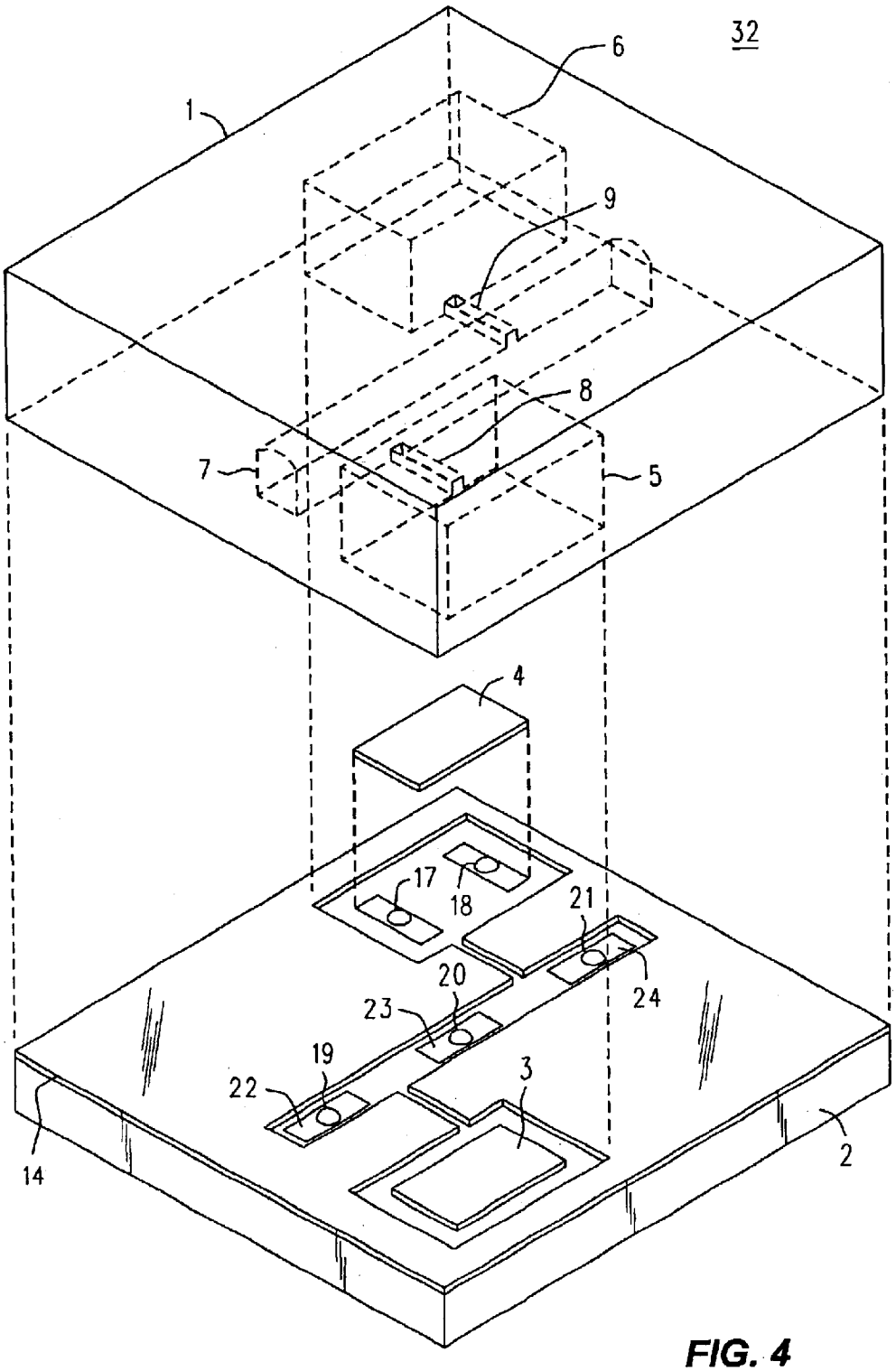
FIG. 4 PRIOR ART
FIG. 4 is an exploded view of a SPDT LIMMS similar to what is shown in FIGS. 1–3, but where the heaters are disposed both on opposite sides and on opposite ends of the channel.

Once layer 36 has been formed and patterned, metallic regions 41–43 are deposited. These correspond to metallic contacts 22–24 of FIG. 4, and serve to improve electrical contact with the liquid metal and to provide a surface that can be wetted by the liquid metal (for latching). Regions 41–43 may be deposited by thin film techniques, in which case it may be important that any high temperature firings needed to cure the dielectric layer 36 have already been performed.

If desired, a strip of metal 37 may be applied around the perimeter of the LIMMS device. Such a strip 37 is part of an hermetic seal with a cover plate 38 and formed of solder (discussed in connection with FIG. 6). Cover plate 38 is preferably of ceramic, although one could use glass, as well. On the underside of the cover plate is applied a patterned layer 40 of adhesive, such as CYTOP. The patterning matches that of the dielectric layer 36 that it is to mate against, and is shown by the dotted lines. Also shown as dotted lines are metalized regions 52, 53 and 54 that correspond to the regions 41–43 formed in the channel 46. Metalized regions 52–53 offer additional surface for wetting at the various locations of the liquid metal, and may also be deposited by thin film techniques. The hermetic seal may also involve there being a beveled edge 39 along the perimeter of the cover plate 38.

To assemble the LIMMS shown in view 25 of FIG. 5, the channel 46 would receive its droplets of liquid metal (not shown) and, while in an atmosphere of a suitable gas, such as $N_2$, the cover plate 38 would be affixed against the substrate 26 bearing the patterned layer 36 of dielectric material. Then the hermetic seal would be formed.

Refer now to FIG. 6, wherein is shown a side cross sectional view 33 of the embodiment of FIG. 5, and wherein like elements have the same reference character. In particular, note that cover plate 38, which in this example may be of ceramic, has a beveled edge 39 that has received a metallic layer 47. Note also the layer of metal (37,48) that is deposited along the perimeter of the patterned layer 36 of dielectric. When the cover plate 38 is registered onto the patterned layer of dielectric 36 the two metal surfaces 47 and 48 form a region within which a fillet 49 of solder may be placed. The fillet of solder 49 forms a very reliable hermetic seal.

FIG. 7 is a side cross sectional view 55 similar to that of FIG. 6, except that the hermetic seal is a fillet 50 of glass frit. Also, cover plate 51 is of glass (as an example only, it might as well be ceramic), and lacks the beveled edge. Also absent are metalized strips (49, 37,48) around the perimeter, since glass frit already adheres to the patterned dielectric and to both ceramic and glass.

We claim:

1. An electrical switching assembly comprising:

a first non-conductive substrate having a surface;

a layer of dielectric material deposited upon the surface of the first non-conductive substrate and patterned to create heater cavities, a liquid metal channel and passages connecting the heater cavities to locations along the liquid metal channel;

a second non-conductive substrate having a surface;

a layer of adhesive deposited on the surface of the second non-conductive substrate and patterned to match the pattern of the layer of dielectric material; and the surfaces of the first and second non-conducting substrates facing each other and being brought into contact through the intervening layer of dielectric material and the layer of adhesive.

2. An electrical switching assembly as in claim 1 wherein at least one of the first and second non-conductive substrates is of glass.

3. An electrical switching assembly as in claim 1 wherein at least one of the first and second non-conductive substrates is of ceramic.

4. An electrical switching assembly as in claim 1 further comprising conductive traces deposited upon the surface of the first non-conductive substrate and beneath the layer of dielectric material.

5. An electrical switching assembly as in claim 1 wherein the perimeter of the second non-conductive substrate lies within the perimeter of the layer of dielectric material and further comprising an hermetic seal formed around the perimeter of the second non-conductive and the layer of dielectric material.

6. An electrical switching assembly as in claim 5 wherein the hermetic seal is of solder.

7. An electrical switching assembly as in claim 1 wherein the hermetic seal is of glass frit.

8. An electrical switching assembly as in claim 1 wherein the layer of dielectric material is deposited with thick film techniques.

* * * * *